United States Patent [19]

Colleran et al.

[11] Patent Number: 5,076,802

[45] Date of Patent: Dec. 31, 1991

[54] WIRE DRESS COVER

[75] Inventors: Stephen A. Colleran, Lisle, Ill.; Michael J. Gardner, Rochester Hills, Mich.; Bill B. Wilson, Montgomery, Ill.

[73] Assignee: Molex Incorporated, Lisle, Ill.

[21] Appl. No.: 636,169

[22] Filed: Dec. 31, 1990

[51] Int. Cl.[5] ..... H01R 13/58

[52] U.S. Cl. ..... 439/468

[58] Field of Search ..... 439/460, 468, 473, 466, 439/467, 465, 470, 902, 142, 147, 367, 521, 892, 686, 701; 174/138 F, 67

[56] References Cited

U.S. PATENT DOCUMENTS

| | | | |
|---|---|---|---|
| 2,526,606 | 10/1950 | Gregg | 439/147 |
| 4,083,618 | 4/1978 | Busch, Jr. | 174/67 |
| 4,130,330 | 12/1978 | Chandler | 439/460 |
| 4,211,463 | 7/1980 | Chandler | 439/468 |
| 4,214,803 | 7/1980 | McKee et al. | 439/468 |
| 4,421,376 | 12/1983 | Cosmos et al. | 439/461 |

FOREIGN PATENT DOCUMENTS 0080813 3/1986 European Pat. Off. .

*Primary Examiner*—Gary F. Paumen

*Attorney, Agent, or Firm*—Louis A. Hecht; Stephen Z. Weiss; A. A. Tirva

[57] ABSTRACT

A wire dress cover is provided for an electrical connector. The connector includes a channel on the rear face into which the wire dress cover is slidably engagable. The wire dress cover includes a rib for slidable engagement in the channel and a locking projection for lockingly engaging the housing after a full seating thereon. The wire dress cover includes a slot extending centrally therein to enable the cover to be pinched for disengaging the locking prjections from the housing. In certain embodiments the wire dress cover is defined by a pair of wire dress cover shells which are lockingly engagable with one another.

18 Claims, 4 Drawing Sheets

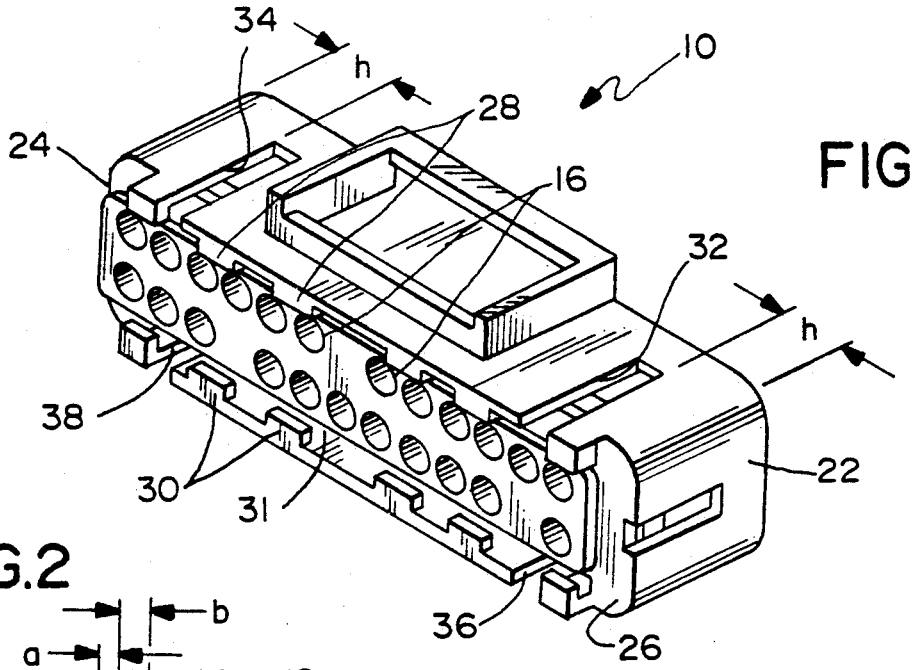
FIG.1
FIG.2
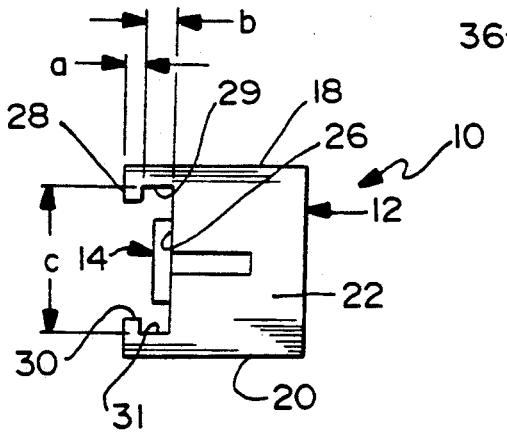
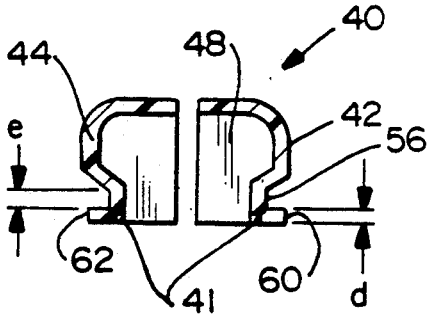
FIG.7
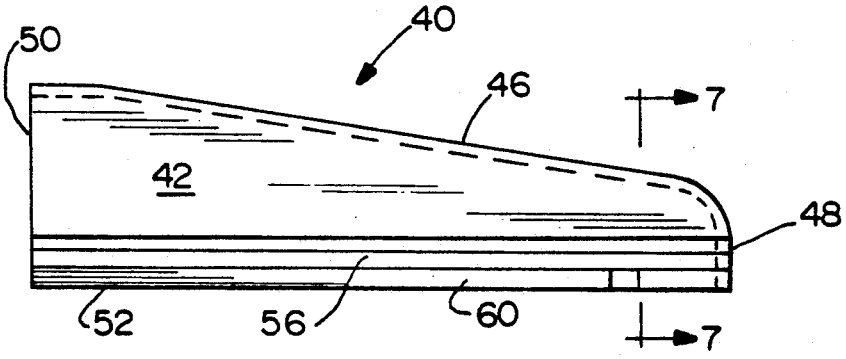
FIG.3
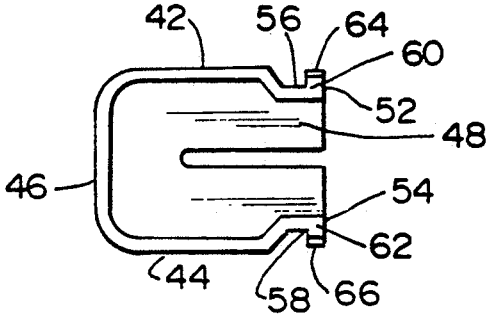
FIG.5

(2-4)
FIG.4
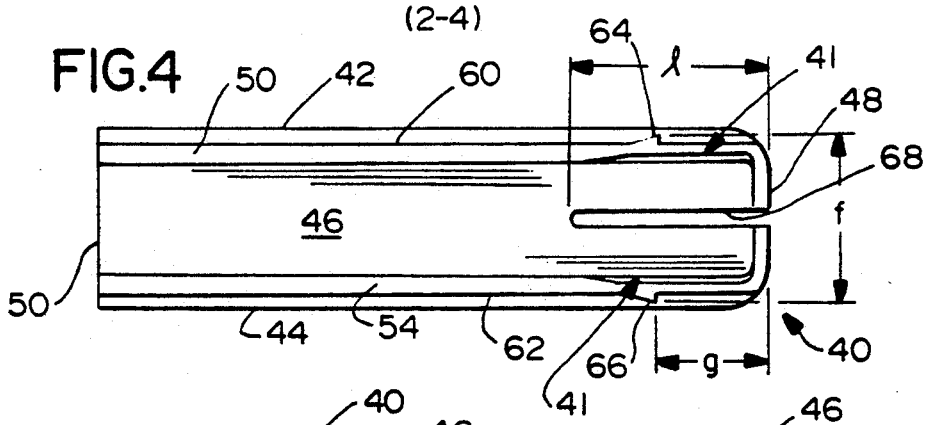
FIG.9
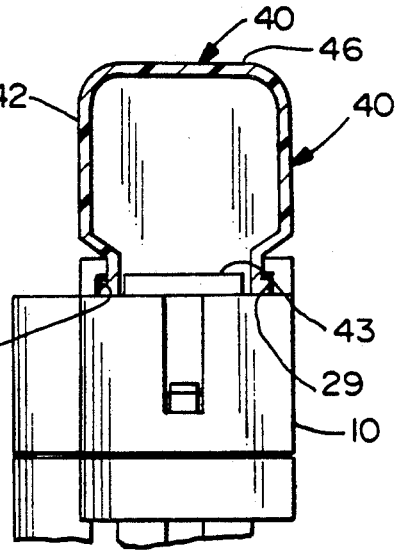
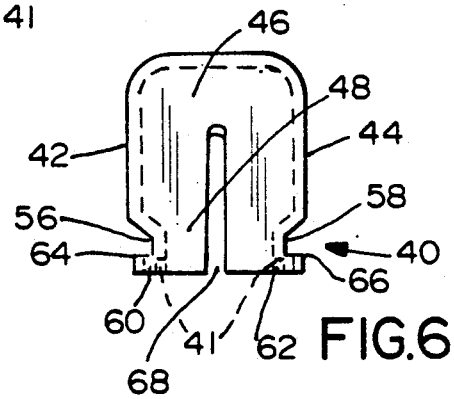
FIG.6
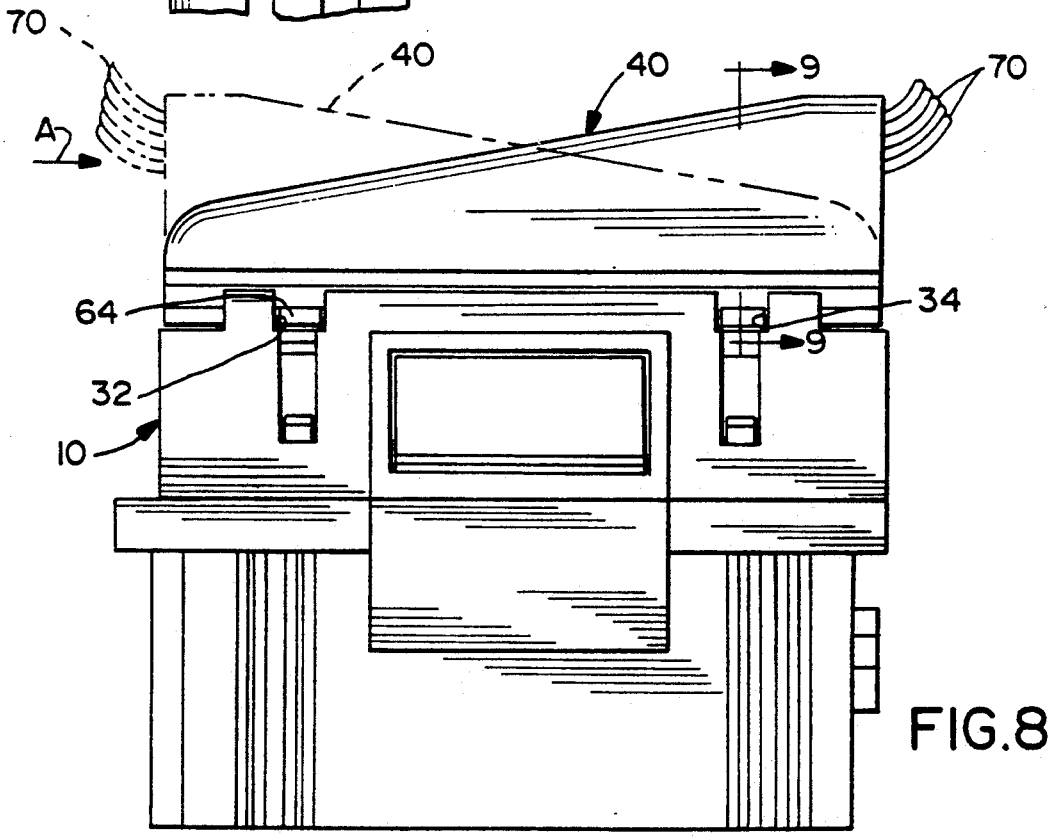
FIG.8

WIRE DRESS COVER

BACKGROUND OF THE INVENTION

An electrical connector comprises a housing with electrically conductive terminals therein. Each terminal is electrically connected or terminated to a conductor in a wire. The electrical connector housing includes opposed forward and rear ends. The forward end is constructed to mate with the housing of another connector, such that the terminals in the respective housings mate with one another and provide electrical connection therebetween. The opposed rear end of the electrical connector housing defines the portion from which the wires extend.

Many electrical connectors are employed in environments where forces may be exerted on the wires extending from the rear end. These forces can damage the electrical termination of the wires to the terminals in the housing Electrical connectors with a large number of wires are particularly susceptible to having, damaged electrical terminations within the connector housing. For example, wires from one connector may tangle with wires from other connectors such that the movement of any one connector may damage the termination of wires in other connectors. The tangling of wires also can make the tracing of wires during troubleshooting operations difficult to achieve. Also accessibiity to a connector latching system is increased with wires which are bundled together at the connector housing rear end.

Prior art electrical connectors have employed covers, boots or the like on the rear end of the connector housing to orient or dress the wires. Some prior art wire dress covers define a unitary member having an aperture through which the plurality of wires pass. Covers of this type generally are effective, but complicate the termination and assembly process. More particularly, the cover may have to be mounted over the wires prior to termination and prior to inserting the terminated wires into the housing. Repairs or replacement of damaged or defective leads after termination and insertion is similarly complicated by the need to extract one lead from the aperture in the cover and insert another lead therethrough. This is particularly difficult if the cover tightly engages the wires to contribute to either sealing or strain relief.

The prior art further includes wire covers that can be mounted to the connector after termination and after proper seating of the terminals in the connector. These prior art connectors have included a unitary cover effectively defining a channel mounted to the rear end of the electrical connector housing. Examples of such prior art connectors are shown in U.S. Pat. No. 4,130,330 which issued to Chandler on Dec. 19, 1978; U.S. Pat. No. 4,211,463 which issued to Chandler on July 8, 1980; and U.S. Pat. No. 4,214,803 which issued to McKee et al. on July 29, 1980. Other prior art connectors have included multi-component housings including a plurality of components for engaging the wires passing into the electrical connector housing. A prior art connector of this general type is shown in U.S. Pat. No. 4,421,376 which issued to Cosmos et al. on Dec. 20, 1983 and European Patent Publication No. 0 080 813 to McCleerey which was published on Mar. 26, 1986.

These prior art covers generally require separate means for engaging the cover around the wires or retaining the cover to the housing. The mounting of these prior art covers to the rear end of the connector housings has not been well-suited to automated manufacturing processes. Furthermore, the prior art covers generally have required an initially manual gathering of the wires prior to mounting of the cover. The prior art covers also have been difficult to remove from the electrical connector housing to which they are mounted. In particular, in most instances, it has been necessary to first remove the separate mounting means from the housing and subsequently disengaging the cover. Most of these prior art covers have not been constructed to provide significant structural protection for the rear end of the electrical connector, and particularly the wires extending therefrom.

In view of the above, it is an object of the subject invention to provide a wire dress cover for efficient lockable mounting to the rear end of an electrical connector housing.

It is another object of the subject invention to provide a wire dress cover that can readily be removed from the electrical connector housing.

A further object of the subject invention is to provide an assembly of components including an electrical connector housing and wire dress cover mountable thereto.

An additional object of the subject invention is to provide a hermaphroditic assembly of wire dress cover shells for cooperating with one another and with an electrical connector housing to gather and protect wires extending from the rear end of the housing.

Yet another object of the subject invention is to provide a wire dress cover which can be mounted to an electrical connector housing in more than one orientation.

Still a further object of the subject invention is to provide a wire dress cover and electrical connector housing that are well suited to automated assembly.

SUMMARY OF THE INVENTION

The subject invention is directed to a wire dress cover for an electrical connector and to the combination of an electrical connector housing and a wire dress cover. The wire dress cover may be formed from a plastic material and may be dimensioned for slidable engagement with the rear end of an electrical connector housing. Preferably the wire dress cover may be slidably engaged in either of at least two optional directions on the housing so that wires extending from the rear end of the housing may be directed in the most convenient manner.

The sliding engagement of the wire dress cover with the electrical connector housing may be achieved by ribs molded unitary with the wire dress cover and adjacent an open face thereof. The ribs may be engagable with a channel defined on the rear end of the housing. The channels on the housing may be defined by a plurality of appropriately directed fingers disposed in a common plane for slidable engagement with the ribs of the wire dress cover. The ribs of the wire dress cover and the channels on the housing both may be generally outwardly directed. However, inwardly directed arrangements of ribs and channels may be provided. In still other embodiments, the channel may be defined on the wire dress cover while one or more ribs may be defined on the housing.

Locking means may be provided for locking the wire dress cover to the housing. The locking means may be defined by latch means disposed on the wire dress cover for engaging corresponding structure on the housing. Means for disengaging the latch means may also be provided, and may comprise deflectable portions on the wire dress cover which enable selective release of the latch means. For example, the wire dress cover may be provided with a slot therein which enables areas of the wire dress cover adjacent the latch means to be deflected for disengaging the latch means from the locking structure on the housing.

The wire dress cover may comprise a pair of shells which are slidably engagable with the rear end of the electrical connector housing from opposite directions, and which are selectively lockingly engagable with one another. The pair of wire dress cover shells may comprise wire guide means for guiding the wires in a selected direction. For example, the wire dress cover shells may be configured to align the wires generally parallel to the mating axis of the connector or generally orthogonal thereto. The pair of wire dress cover shells may be substantially identical to define a hermaphroditic pair for engagement with one another on the housing.

The linear sliding movement of the wire dress cover is well suited to automated manufacturing processes. In particular, the slidable movement of the wire dress cover onto the housing will automatically gather the wires and ensure proper alignment of the wires relative to the housing. Complete advancement of the wire dress cover onto the housing automatically will achieve a locked but releasable engagement between the wire dress cover and the housing. In all embodiments a manual gathering of wires may not be needed and the resulting structure may be sufficiently rigid to protect the rear end of the housing.

BRIEF DESCRIPTION OF THE DRAWINGS

FIG 1 is a perspective view of an electrical connector housing for use with a wire seal cover in accordance with the subject invention.

FIG. 2 is a side elevational view of the housing shown in FIG. 1.

FIG. 3 is a front elevational view of a wire dress cover in accordance with the subject invention.

FIG. 4 is a bottom plan view of the wire dress cover shown in FIG. 3.

FIG. 5 is an elevational view of the wire dress cover as viewed from the left side of FIGS. 3 and 4.

FIG. 6 is an end elevational view of the wire dress cover as viewed from the right side of FIGS. 3 and 4.

FIG. 7 is a cross sectional view taken along line 7—7 in FIG. 3.

FIG. 8 is a top plan view of the wire dress cover mounted to the electrical connector housing of FIG. 1.

FIG. 9 is a cross sectional view of the wire dress cover and housing taken along line 9—9 in FIG. 8.

DETAILED DESCRIPTION OF THE PREFERRED EMBODIMENT

Figure 10:
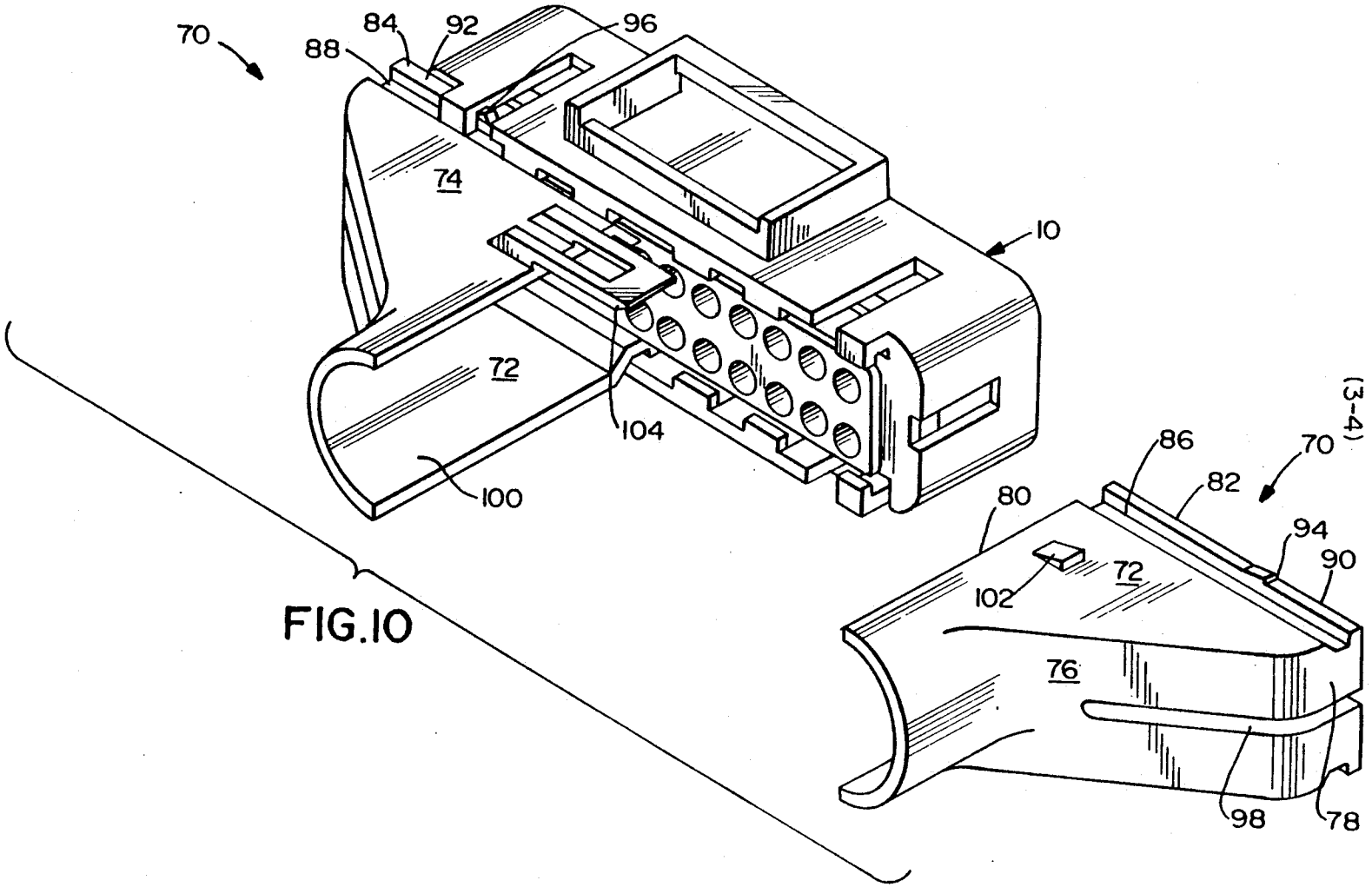
FIG. 10 is an exploded perspective view of a second embodiment of a wire dress cover for mounting to the electrical connector of FIG. 1.

An electrical connector housing for use with the wire dress covers of the subject invention is identified generally by the numeral 10 in FIGS. 1 and 2. The housing 10 is unitarily molded from a nonconductive material and includes a forward mating end 12 and an opposed rear end 14, with a plurality of terminal receiving cavities 16 extending therebetween. The housing 10 is of generally rectangular configuration and includes a first side 18, an opposed second side 20 and opposed ends 22 and 24 respectively. The rear end 14 of the electrical connector housing 10 is characterized by a generally planar region 26 extending substantially entirely around the periphery thereof. Portions of the first side 18 of the electrical connector housing 10 adjacent the rear end 14 are characterized by a plurality of fingers 28 which project toward the second side 20 and which are spaced from the planar peripheral surface 26 to define a channel 29 therebetween. Similarly, portions of the second side 20 adjacent the rear end 14 of the housing 10 are similarly characterized by fingers 30 which project toward the first side 18 and which are spaced from the planar peripheral surface 26. Thus, a channel 31 is defined between the fingers 30 and the planar peripheral surface 26. Each finger 28, 30 defines a front-to-rear dimension "a", as shown in FIG. 2. The fingers 28 and 30 are disposed to lie substantially in a common plane which is parallel to the planar peripheral surface 26. Thus, the channels 29 and 31 are of substantially equal cross sectional dimensions "b". The distance across the opposed channels 29 and 31 is indicated by dimension "c".

The housing 10 is provided with locking slots 32 and 34 at portions of the first side 18 adjacent the rear end 14. Similarly, locking slots 36 and 38 are formed in the second side 20 of the housing 10 at the rear end 14 thereof. As will be explained further below, the locking slots 32–38 are disposed and dimensioned to engage locking projections on the wire dress cover as explained further below.

A first embodiment of a wire dress cover in accordance with the subject invention is identified generally by the numeral 40 in FIGS. 3–7. The wire dress cover 40 is unitarily molded from a plastic material and effectively defines an open shell. More particularly, the wire dress cover 40 includes opposed substantially identical parallel first and second side walls 42 and 44. A rear wall 46 extends orthogonally between the first and second side walls 42 and 44. A first end wall 48 also extends orthogonally between the first and second side walls 42 and 44 and further unitarily extends from the rear wall 46. A second end 50 of the wire dress cover 40 is substantially open and defines a region for the substantially dressed or aligned wires (not shown) to extend from the wire dress cover 40. The wire dress cover 40 further includes an opened front face defined by first and second front edges 52 and 54 of the respective first and second side walls 42 and 44. In the embodiment depicted herein the first and second side walls 42 and 44 are of substantially trapezoidal configuration, as shown most clearly in FIG. 3. More particularly, the first and second walls 42 and 44 define a greater front-to-rear depth at portions nearer the second face 50 than at those portions nearer the first end wall 48. This configuration relates to the gathering function of the wire dress cover 40 as Will be explained further below.

The first and second side walls 42 and 44 are characterized by inwardly formed grooves 56 and 58 respectively generally adjacent to the corresponding front edges 42 and 44 thereof. More particularly, as shown in FIG. 7 the grooves 56 and 58 effectively define outwardly projecting ribs 60 and 62 respectively defining a thickness "d" which is slightly less than the cross sectional dimension "b" of the channels 29 and 31 in the housing 10, as depicted in FIG. 2 and described above. The grooves 56 and 58 of the wire dress cover 40 define thicknesses "e" which is slightly greater than the dimension "a" of the fingers 28, 30 on the housing 10. Thus, as will be explained further below, the ribs 60 and 62 of the wire dress cover 40 may be slid into the channels 29 and 31 of the housing 10 such that the fingers 28 and 30 of the housing 10 are slidably engaged in the grooves 56 and 58. The ribs 60 and 62 of the wire dress cover 40 are characterized by ramped locking projections 64 and 66 at locations thereon generally in proximity to the first end wall 48 of the wire dress cover 40. More particularly, the ramped faces of the locking projections 64 and 66 are generally facing the opened second end 50 of the wire dress cover 40, while the locking faces thereof are generally facing the first end wall 48. The locking projections 64 and 66 define a major dimension height "f" across the ribs 60 and 62 which is greater than the corresponding height "c" across the channels 29 and 31 on the housing 10 as shown in FIG. 2. Thus, a slight deformation of the wire dress cover 40 will be required causing the cut out portions 41 of ribs 60 and 62 located near the slot 68 to move into contact with the guidance section 43 as the locking projections 64 and 66 are urged into the channels 29 and 31 of the housing 10. The forces for such deformation will be generated by the ramped faces of the locking projections 64 and 66. The locking projections 64 and 66 are spaced from the first end wall 48 by a distance "g" as shown in FIG. 4 substantially corresponding to the distance "h" in FIG. 1 between the locking slots 32 and 36 and the first end 22 of the housing 10, and by the distance between the locking slots 34 and 38 and the second side 24 of the housing 10. Thus, as will be explained further herein, the locking projections 64 and 66 are disposed and dimensioned to lockingly engage either the locking slots 32 and 36 or the locking slots 34 and 38 to securely retain the wire dress cover 40 on the housing 10.

The wire dress cover 40 is further characterized by a slot 68 extending into the first end wall 48 and continuing into a portion of the rear wall 46 in proximity to the first end wall 48. More particularly, the slot 68 extends into the rear wall 46 a distance "i" greater than the spacing "j" of the locking projections 64 and 66 from the first end wall 48, as shown in FIG. 4. The slot 68 is provided to enable portions of the first and second side walls 42 and 44 near the locking projections 64 and 66 to be pinched toward one another for releasing the locking projections 64 and 66 from the corresponding locking slots 32 and 36 or 34 and 38 on the housing 10.

The wire dress cover 40 is shown mounted to the connector housing 10 in FIGS. 8 and 9. More particularly, the wire dress cover 40 can be slid in the direction indicated by arrow "A" in FIG. 8 such that the edges 42 and 44 of the wire dress cover 40 side along the planar surface 26 of the housing 10 and into the channels 29 and 31 on the rear end 14 of the housing 10. The sliding movement of the wire dress cover 40 gathers the wires 70 into a generally aligned array. After sufficient slidable advancement of the wire dress cover 40 in direction "A" the latches 64 and 66 will engage in the apertures 34 and 38 respectively to lockingly retain the wire dress cover 40 in its fully seated position on the housing 10. The wire dress cover 40 can be removed from the housing 10 by merely pinching areas of the first and second second side walls 42 and 44 adjacent the end wall 48 toward one another. This pinching movement is facilitated by the slot 68 and the entrance between the ribs 60, 62 and the lateral edge of guidance 43 covered by cut out portions 41 on ribs 60, 62, and will enable sufficient deformation of the wire dress cover 40 for disengagement of the latches 64 and 66 from the apertures 34 and 38 respectively. The general direction of the pinching forces is illustrated by arrows "B" in FIG. 9.

As shown by broken lines in FIG. 8, the wire dress cover 40 may be mounted in an opposite direction on the housing 10. The particular orientation of the wire dress cover 40 on the housing 10 will depend upon the most efficient alignment of the wires 70. In the orientation depicted in broken lines, the latches 64 and 66 will engage in the locking apertures 32 and 36 on the housing 10.

A second embodiment of the subject invention is illustrated in FIG. 10 and comprises identical hermaphroditic wire dress cover shells 70 each of which is engagable with the housing 10 and which are engagable with one another. Each wire dress cover shell 70 includes opposed first and second side walls 72 and 74, a rear wall 76, a first end wall 78, a second opened end 80 and front edges 82 and 84. The front edges 82 and 84 are characterized by grooves 86 and 88 respectively defining cross sections substantially identical to the grooves 56 and 58 on the embodiment depicted in FIGS. 3–9. Thus, the fingers 28 and 30 of the housing 10 are engagable in the grooves 86 and 88. Ribs 90 and 92 are further defined adjacent the front edges 82 and 84 respectively on each wire dress cover shell 70 and define cross sections substantially identical to the ribs 60 and 62 on the wire dress cover 40 described and depicted above. Thus, the ribs 90 and 92 are slidably engagable in the channels 29 and 31 on the rear end 14 of the housing 10. The ribs 90 and 92 are further characterized by locking projections 94 and 96 for locking engagement in the locking apertures 32–38 on the housing 10. The hermaphroditic wire dress cover shells 70 are further characterized by slots 98 extending centrally through the end wall 78 and a portion of the rear wall 76 to enable a pinching of each wire dress cover shell 70 to disengage the locking projections 94 and 96 from the associated locking apertures 32 and 36 or 34 and 38 on the housing 10.

The hermaphroditic wire dress cover shells 70 differ from the wire dress cover 40 in several respects. In particular, the width of the wire dress cover 70 as measured along either front edge 82 or 84 is approximately one-half the corresponding width of the wire dress cover 40 described and illustrated above. Thus, the hermaphroditic wire dress cover shells 70 will mount only to one-half of the rear face 14 of the housing 10.

The hermaphroditic wire dress cover shells 70 are further characterized by generally semi-cylindrical portions 100 extending from the rear wall 76 such that the axis of the semi-cylindrical portion 100 extends in a generally front to rear direction and will align with the mating axis of the housing 10. The semi-cylindrical portions 100 are disposed to align with one another on the housing to define a cylinder in which the wires from the housing 10 are gathered to extend in a generally rearward direction away from the housing 10.

The first side wall 72 of each hermaphroditic wire dress cover shell 70 is further characterized by an outwardly extending locking projection 102, while the second side wall 74 thereof is defined by a deflectable latch 104 extending beyond the opened second end 80 of the wire dress cover shell 70. The relative positions and dimensions of the projection 102 on the first side wall 72 and the latch 104 on the second side wall 74 are such that the latch 104 will engage the locking projection 102 when a pair of the hermaphroditic wire dress cover shells 70 are fully mounted from opposite directions on the housing 10.

Figure 11:
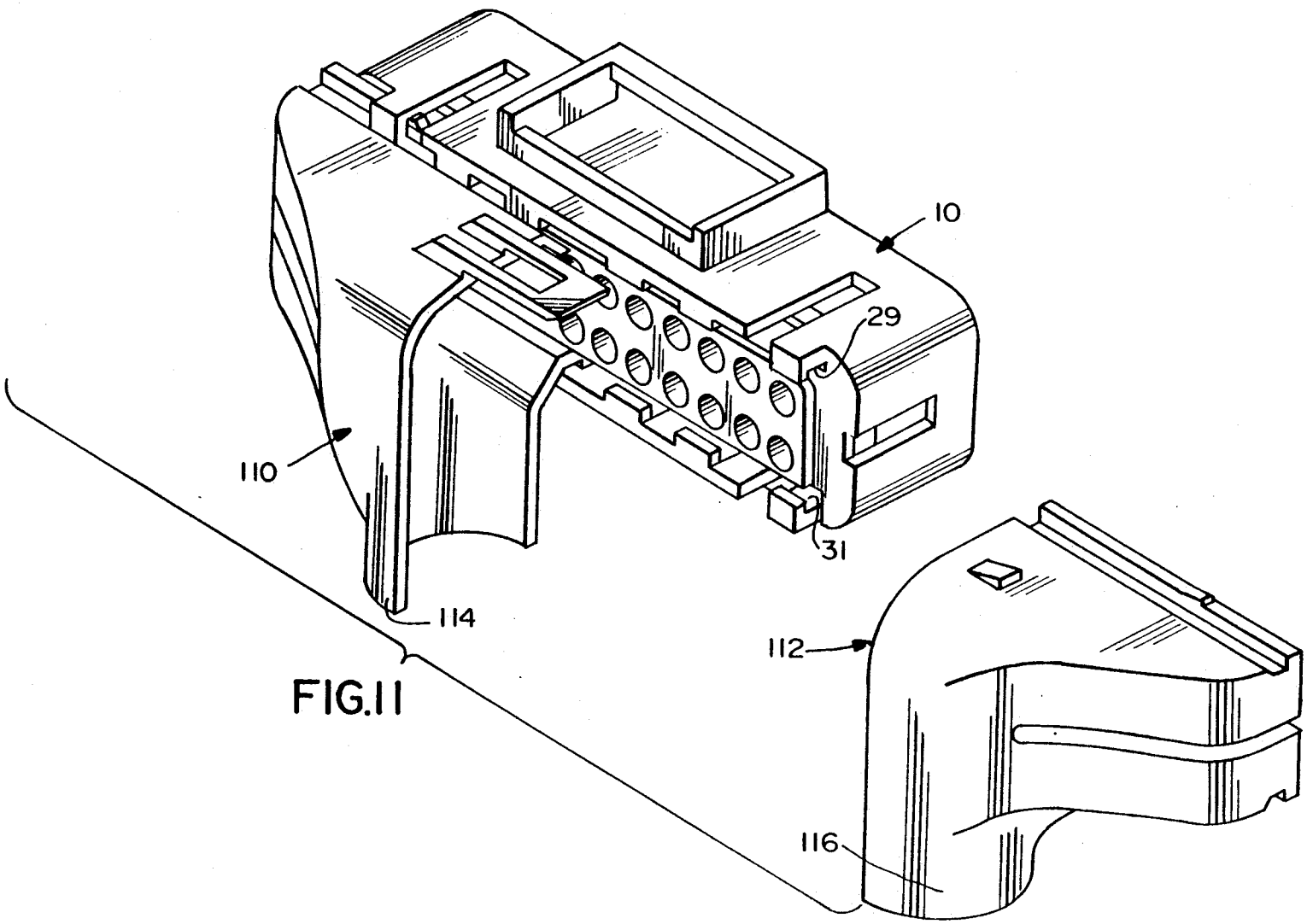
FIG. 11 is an exploded perspective view of a third embodiment of a wire dress cover for mounting to the electrical connector of FIG. 1.

Different embodiments of wire dress cover shells are illustrated in FIG. 11 and are identified generally by the numeral 110 and 112. The wire dress cover shells 110 and 112 are structurally and functionally similar to the wire dress cover 40 illustrated in FIGS. 3–7 and the hermaphroditic wire dress cover shells 70 illustrated in FIG. 10. However, in place of the rearwardly extending semi-cylindrical portion 100 for gathering the wires on the shell 70, the wire dress cover shells 110 and 112 include semi-cylindrical portions 114, 116 which are aligned orthogonally to the front to rear mating axis of the connector housing 10. Thus, the wire dress cover shells 110 and 112 are not identical but are mirror images of one another. The semi-cylindrical portions 114 and 116 will gather and direct wires beyond either the first or second sides 18 or 20 of the housing 10 and in a direction orthogonal to the mating axis of the housing 10 depending on which end of housing 10 the wire dress covers 110 and 112 are mounted. The wire dress cover shells 110 and 112 are in other respects substantially identical to the wire dress cover shells 70 and can be slidably mounted into the channels 29 and 31 on the rear face 14 of the housing 10 for locking engagement with the housing 10 and for locking engagement with one another.

In summary, a wire dress cover is provided for slidable locking engagement with an electrical connector housing. The wire dress cover is configured to gather and dress wires as the cover is being slid into engagement on the rear end of the electrical connector housing. In the full seated position, the wire dress cover will provide an efficient alignment of all wires extending from the rear end of the electrical connector housing. The wire dress cover is further provided with latches for engaging the housing. A slot facilitates a pinching of a portion of the wire dress cover to disengage the latches from the housing and to enable separation of the wire dress cover from the housing. In certain embodiments the wire dress cover is defined by a pair of shells for gathering and dressing the wires. The wire dress cover shells in each such pair each include means for locking engagement with the housing and means for locking engagement with one another.

While the invention has been described with respect to certain preferred embodiments, it is apparent that various changes can be made without departing from the scope of the invention as defined by the appended claims. For example, the gathering means may be aligned to extend the wires in other directions and the locking means may be differently configured to achieve other locking configurations suitable for the particular environment.

We claim:

1. A Wire dress cover for an electrical connector comprising first and second generally parallel side walls having front edges configured for sliding engagement with the electrical connector, a rear wall extending between and connecting the first and second side walls at locations thereon generally opposite the front edges of the first and second side walls, the rear wall being provided with a slot extending generally parallel to the first and second side walls, the slot being disposed and dimensioned to facilitate inward deflection of the first and second walls for disengaging the front edges of the first and second walls side walls from the electrical connector.

2. A wire dress cover as in claim 1 further comprising a first end wall extending from the rear wall and extending between the first and second side walls, the wire dress cover further defining an opened second end for gathering wires of the electrical connector to be dressed.

3. A wire dress cover as in claim 2 wherein the first end wall comprises a slot extending substantially continuously from the slot in the rear wall for facilitating the deflection of the first and second side walls for disengaging the front edges from the electrical connector.

4. A wire dress cover as in claim 2 further comprising a generally semi-cylindrical wall adjacent the opened second end for gathering the wires from the electrical connector.

5. A wire dress cover as in claim 4 wherein the electrical connector includes a mating axis, the generally semi-cylindrical wall of the wire dress cover including a longitudinal axis aligned substantially parallel to the mating axis of the electrical connector.

6. A wire dress cover as in claim 4 wherein the electrical connector includes a mating axis, the generally semi-cylindrical wall of the wire dress cover including a longitudinal axis aligned substantially orthogonal to the mating axis of the electrical connector.

7. A wire dress cover as in claim 1 comprising a pair of hermaphroditic wire dress cover shells each of which is slidably engagable with the electrical connector, said wire dress cover shells being lockingly engagable with one another.

8. A wire dress cover as in claim 2 wherein at least one of said side walls comprises a locking projection for lockable but releasable connection with the electrical connector.

9. A wire dress cover as in claim 8 wherein the slot extends from the first end wall a distance greater than the distance of said locking projection from the first end wall for facilitating deflection of the locking projection.

10. A wire dress cover as in claim 8 wherein the locking projection includes a ramped face generally facing the opened second end of the wire dress cover and a locking face generally facing the first end wall thereof.

11. An electrical connector assembly comprising a housing having a forward mating end, a rear end and a plurality of terminal receiving cavities extending therebetween, the rear end of the housing defining a pair of generally planar channels therein, the connector assembly further comprising a wire dress cover having first and second opposed side walls having front edges configured for slidable engagement in the channels of the electrical connector housing, a rear wall extending between the first and second side walls of the wire dress cover, said rear wall comprising a slot therein for enabling inward deflection of the first and second side walls for disengaging the wire dress cover from the electrical connector.

12. An electrical connector assembly as in claim 11 wherein the housing includes a plurality of locking means formed therein, said wire dress cover comprising locking means for locked engagement with the locking means of the housing when the wire dress cover is fully seated on the housing, the slot in the wire dress cover being disposed to facilitate deflection of the wire dress cover for disengaging the locking means of the wire dress cover from the locking means of the housing.

13. An electrical connector as in claim 12 wherein the housing comprises first and second sides and the locking means on the housing comprise first and second locking means disposed in proximity to the respective first and second sides, the wire dress cover being slidably engagable with the housing from either of the first and second sides such that the locking means of the wire dress cover engages either the locking means of the housing adjacent the first side of the housing or the locking means of the housing adjacent the second side thereof.

14. An electrical connector as in claim 13 wherein the wire dress cover defines a width substantially equal to the distance between the first and second sides of the housing.

15. An electrical connector as in claim 13 wherein the wire dress cover comprises a pair of wire dress cover shells each of which is slidably engagable to the housing, each said wire dress cover shell defining a width substantially equal to one-half the distance between the sides of the housing such that the wire dress cover shells are slidably engagable on the housing from opposite respective sides thereof and engage one another at locations intermediate the sides of the housing.

16. An electrical connector as in claim 15 wherein each said wire dress cover shell includes locking means for locking engagement with the other wire dress cover shell.

17. An electrical connector as in claim 15 wherein each said wire dress cover shell comprises wire gathering means at locations thereon spaced from the housing, the wire gathering means of said wire dress cover shells being disposed and configured to mate with one another in the fully seated condition of the wire dress cover shells on the housing for engaging wires of the electrical connector therebetween.

18. An electrical connector as in claim 15 wherein the wire dress covers are substantially identical to one another.

* * * * *